US012227918B2

(12) United States Patent
Jamilosa

(10) Patent No.: US 12,227,918 B2
(45) Date of Patent: Feb. 18, 2025

(54) DIPPER LATTICE FRAME AND WEARABLE STRUCTURAL LINER

(71) Applicant: Caterpillar Global Mining LLC, Tucson, AZ (US)

(72) Inventor: James G. Jamilosa, Waipahu, HI (US)

(73) Assignee: Caterpillar Global Mining LLC, Tucson, AZ (US)

( * ) Notice: Subject to any disclaimer, the term of this patent is extended or adjusted under 35 U.S.C. 154(b) by 409 days.

(21) Appl. No.: 17/139,505

(22) Filed: Dec. 31, 2020

(65) Prior Publication Data

US 2022/0205213 A1 Jun. 30, 2022

(51) Int. Cl.
*E02F 3/407* (2006.01)
*E02F 3/30* (2006.01)
*E02F 9/28* (2006.01)

(52) U.S. Cl.
CPC ..... *E02F 3/4075* (2013.01); *E02F 3/308* (2013.01); *E02F 9/2825* (2013.01)

(58) Field of Classification Search
CPC ..... E02F 3/308; E02F 3/4075; E02F 9/2825
See application file for complete search history.

(56) References Cited

U.S. PATENT DOCUMENTS 4,939,855 A 7/1990 McCreary, Jr.
5,063,694 A * 11/1991 McCreary, Jr. ..... E02F 3/40 37/444
10,662,610 B2 5/2020 Rupp et al.
2014/0314537 A1* 10/2014 Bienfang ..... E02F 3/60 37/444
2015/0110592 A1* 4/2015 Voelz ..... E02F 9/2883 414/722
2016/0024745 A1* 1/2016 Lunderskov ..... E02F 9/2207 37/445
2019/0316329 A1* 10/2019 Pratt ..... E02F 9/2883
2020/0123732 A1 4/2020 Hall et al.
2022/0145577 A1* 5/2022 Boss ..... E02F 3/60
2023/0257969 A1* 8/2023 Sinn ..... E02F 9/2833 37/456

FOREIGN PATENT DOCUMENTS

EP 3569060 A1 11/2019
JP 03822450 B2 9/2006
JP 2016084674 A 5/2016
KR 200326547 U 9/2003
KR 938839 B1 1/2010

OTHER PUBLICATIONS

Written Opinion and International Search Report for Int'l. Patent Appln. No. PCT/US2021/053181, mailed Apr. 8, 2022 (10 pgs).

* cited by examiner

*Primary Examiner* — Saul Rodriguez
*Assistant Examiner* — Brendan P Tighe

(57) ABSTRACT

A dipper of a work machine includes a body having a plurality of walls, a rear door, a bowl and a liner. The bowl may have a lattice framework. The liner may be formed from a plurality of plates, with each plate having a top surface that contacts material present in the dipper, and a bottom surface opposite the top surface. Each plate may be welded to the lattice frame from the bottom surface of the plate.

20 Claims, 7 Drawing Sheets

DIPPER LATTICE FRAME AND WEARABLE STRUCTURAL LINER

TECHNICAL FIELD

The present disclosure relates generally to a work machine and, more particularly, to a dipper with a frame and liner.

BACKGROUND

Excavating shovel dippers or buckets are used in construction for transporting material at a worksite. A conventional electric rope shovel utilizes a cable and a series of pulleys to raise and lower a dipper bucket. In operation, material may be scooped into the dipper bucket, transported, and then discharged through a hinged rear door of the dipper bucket into a dump truck or onto a conveyor, for example. Materials transported by shovels and other earth moving equipment at a worksite, however, may be abrasive to work machine implements. Over time, as worksite material moves through and within the dipper bucket for example, abrasive stones, rocks and other similar materials can not only damage interior and exterior surfaces of the dipper bucket, but can also erode structural welds that hold components of the dipper bucket together. Such erosion and damage can cause failure of the dipper bucket, or result in costly repairs and maintenance.

Conventional excavating bucket and dipper designs have evolved as heavy, cast or fabricated structures requiring replacement of the entire bucket, or large portions thereof, to be replaced when worn. Consequently, prior attempts to modify dipper structures have been directed to solution that attempt to make these large portions more easily removable. For example, U.S. Pat. No. 4,939,855 describes an excavating dipper that includes a disposable portion including a bottom wall and sidewalls that extend toward an upper portion. The throw-away section is made of a lighter weight material than the upper portion, and is consequently coupled to the upper portion using fasteners and welds.

Such systems and methods described above for replacing dipper buckets in their entirety, or in large portions, are both costly and result in time consuming repairs. Consequently, there remains a need for improved dipper designs for work machines used in high wear applications such as construction and mining.

SUMMARY

In accordance with one aspect of the present disclosure, a dipper for a work machine is disclosed. The dipper may include a body having a plurality of walls, and may also include a rear door, a bowl and a liner. The bowl may have a lattice framework. The liner may be formed from a plurality of plates, with each plate having a top surface that contacts material present in the dipper, and a bottom surface opposite the top surface. Each plate may be welded to the lattice frame from the bottom surface of the plate.

In accordance with another aspect of the present disclosure, a work machine is disclosed. The work machine may include a rotatable frame, a plurality of ground engaging elements, a boom pivotably coupled to the frame, and a dipper coupled to the boom. The dipper may include a rear door and a body having a plurality of side walls and a top wall. The dipper may also a lattice frame removably attached to each of the plurality of side walls and a liner formed from a plurality plates. Each plate may have a top surface that contacts material present in the dipper and a bottom surface opposite the top surface. Further, each plate may be removably attached to the lattice frame from the bottom surface of the plate.

In accordance with yet another aspect of the present disclosure, a dipper of a work machine is disclosed. The dipper may be configured to transport material at a worksite, and may include a body, a rear door, a bowl and a liner. The body may have a plurality of side walls and a top wall. The rear door may be pivotably attached to the top wall, and the rear door and the body may define a cavity. The bowl may be attached to the body at a bottom edge of each of the plurality of side walls, and may include a lattice frame formed from a plurality of bars arranged in a grid pattern and spaced so as to define a plurality of rectangular openings. The liner may be formed from a plurality of plates, each plate having a top surface configured to contact the material present in the cavity and a bottom surface opposite the top surface. Each plate may be welded to the lattice frame from the bottom surface and along a perimeter of each of the plurality of rectangular openings. The bowl and each of the plurality of plates may be selectively replaceable.

These and other aspects and features of the present disclosure will be better understood upon reading the following detailed description, when taken in conjunction with the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
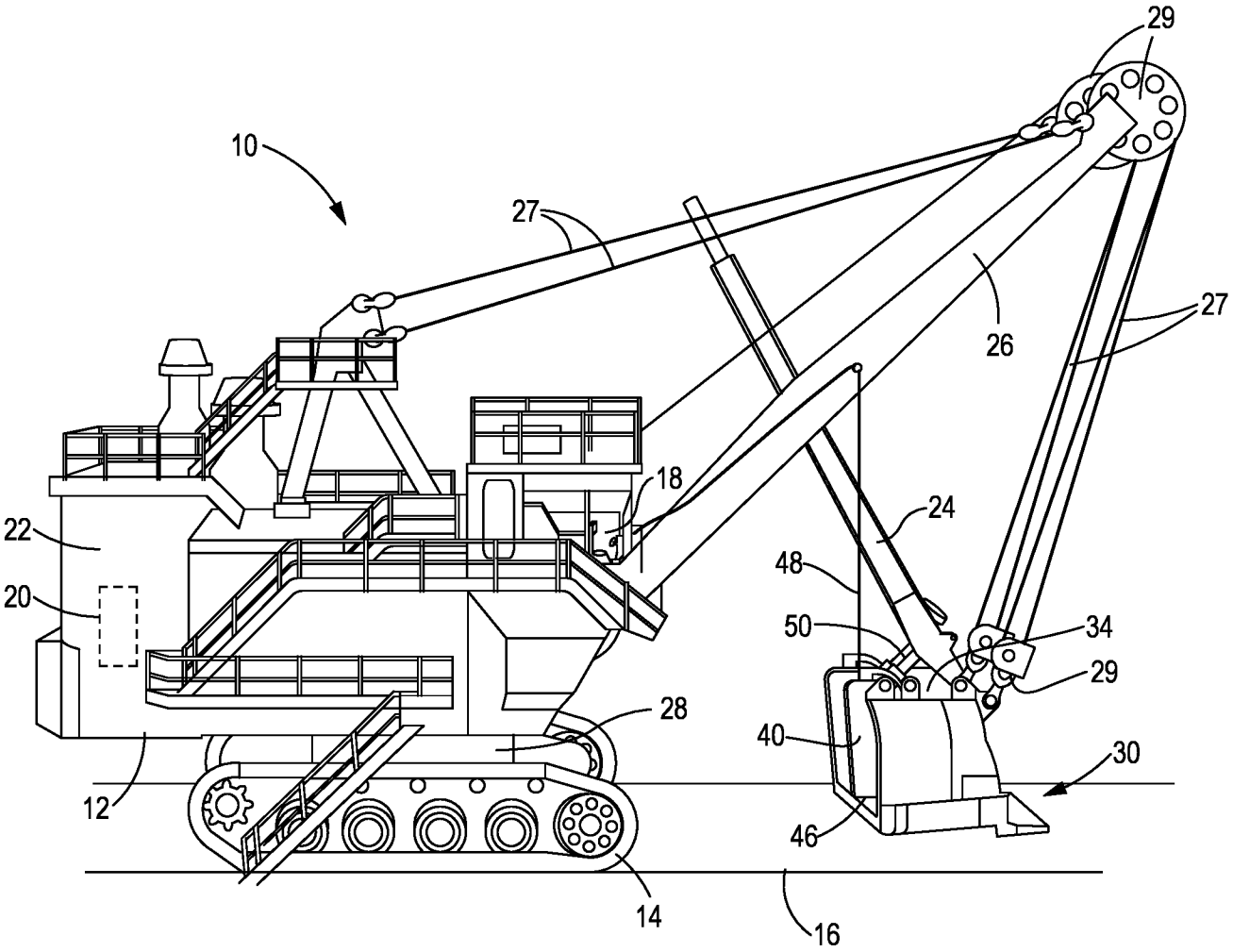
FIG. 1 is a side view of a work machine, according to an embodiment of the present disclosure.

FIG. 1 illustrates a side view of a work machine 10, according to an embodiment of the present disclosure. The exemplary work machine 10 may be a fixed or mobile machine, such as an electric rope shovel, although the features disclosed herein may be utilized with other types of machines, such as backhoes, excavators, dozers, loaders, motor graders, or any other earth moving machines. The illustrated work machine 10 generally includes a frame 12 supported by one or more ground engaging mechanisms 14 configured to engage a ground surface 16 of a worksite.

While the present work machine 10 is illustrated with a pair of endless track assemblies, the ground engaging mechanisms 14 may be of any suitable type, including wheels. The work machine 10 may also include a rotating assembly 28 enabling rotation of the frame 12 relative to the ground engaging mechanisms 14. The work machine 10 may further include an operator cab 18, and a prime mover 20 that may be housed within an enclosure 22. Non-limiting examples of the prime mover 20 may include, for example, a diesel engine, a gasoline engine, a gaseous fuel-powered engine, an electrical motor, a fuel cell, a battery, and/or combinations thereof.

The work machine 10 may also include a boom handle 24 coupled to a dipper or bucket 30 supported by a boom 26, which may be pivotably connected to the frame 12 of the work machine. A plurality of support wires 27 and pulleys 29 may also be used to move and support the dipper relative to the frame 12. The dipper 30 may be configured to hold earth, stone or other worksite materials that are loaded into the dipper by action of the boom handle 24. For example, the boom handle 24 may be configured to push the dipper 30 into the worksite material, thereby filling the dipper 30. Once full, the material in the dipper 30 may be transported to another region of the worksite and deposited.

Figure 2:
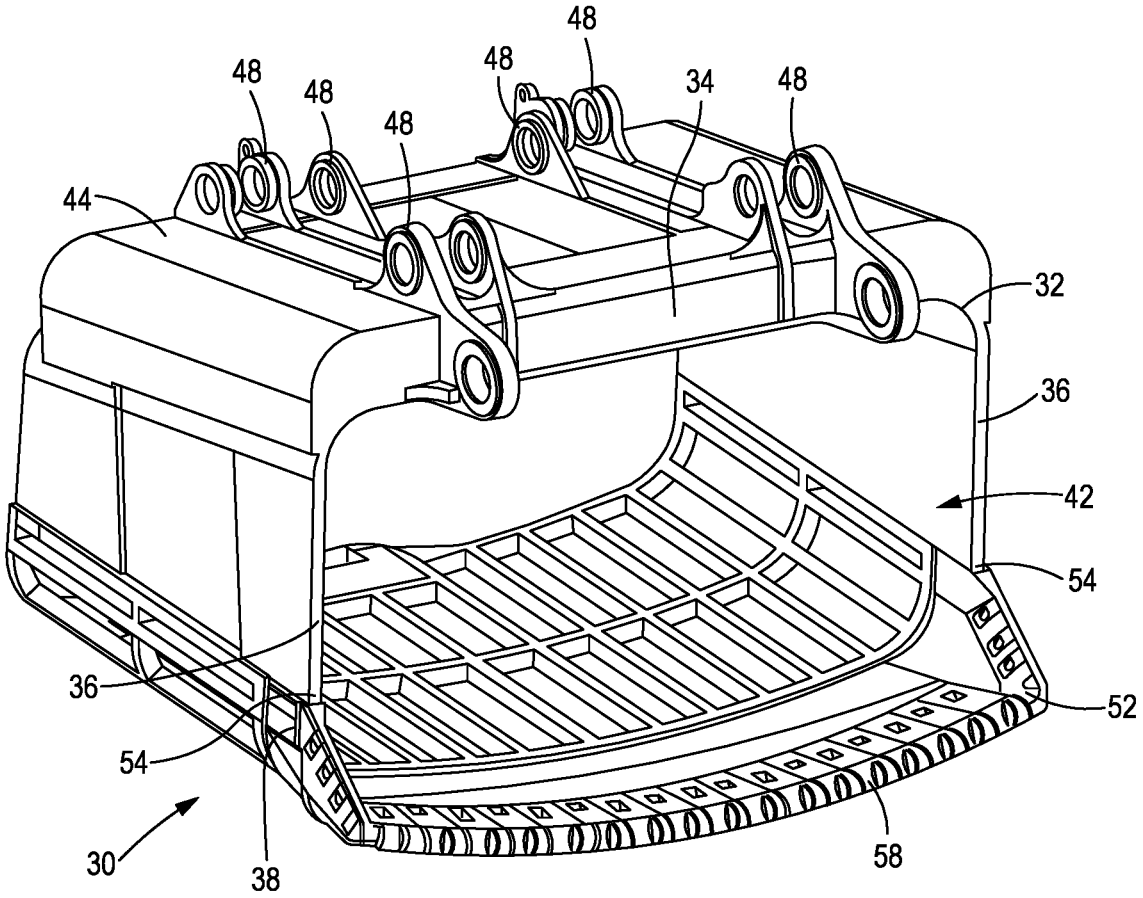
FIG. 2 is a side perspective view of a portion of a dipper of a work machine constructed in accordance with an embodiment of the present invention.
Figure 3:
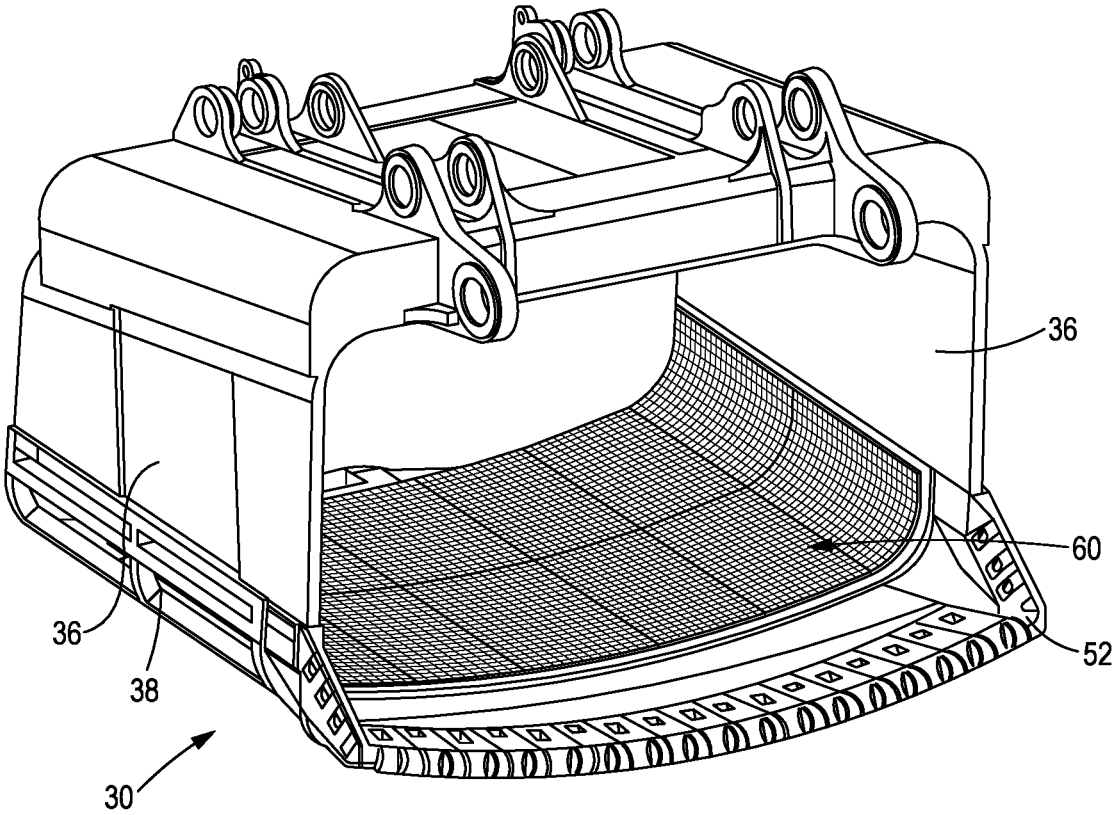
FIG. 3 is a side perspective view of a portion of a dipper of a work machine constructed in accordance with an embodiment of the present invention.
Figure 4:
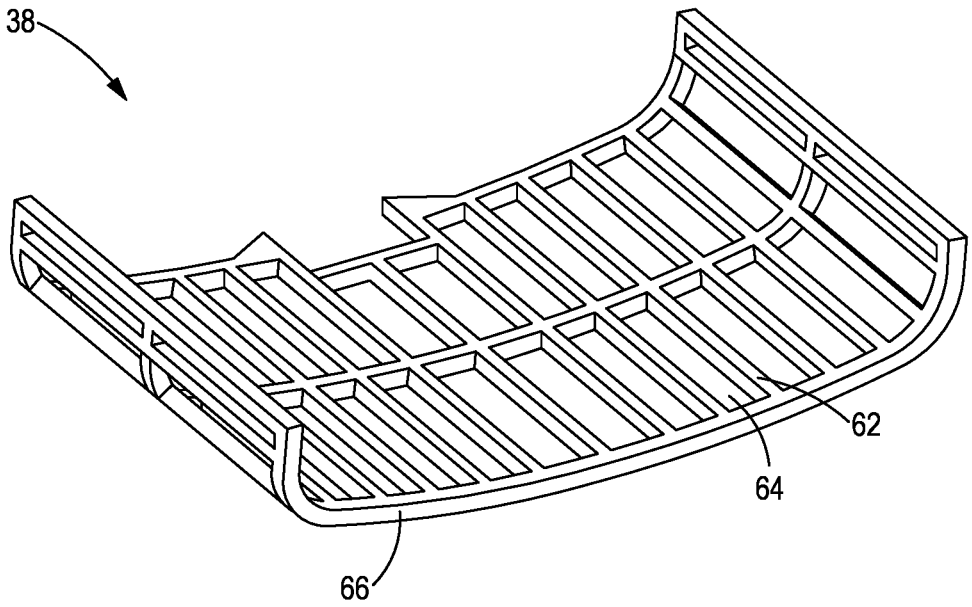
FIG. 4 is a side perspective view of a dipper bowl constructed in accordance with an embodiment of the present invention.
Figure 5:
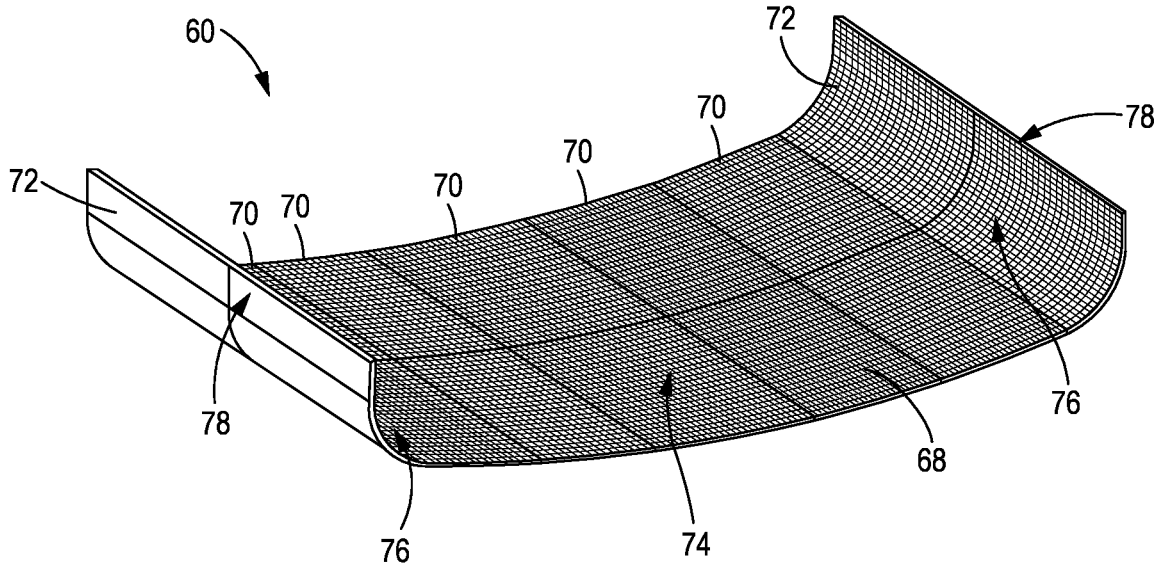
FIG. 5 is a side perspective view of a liner of a dipper bowl constructed in accordance with an embodiment of the present invention.
Figure 6:
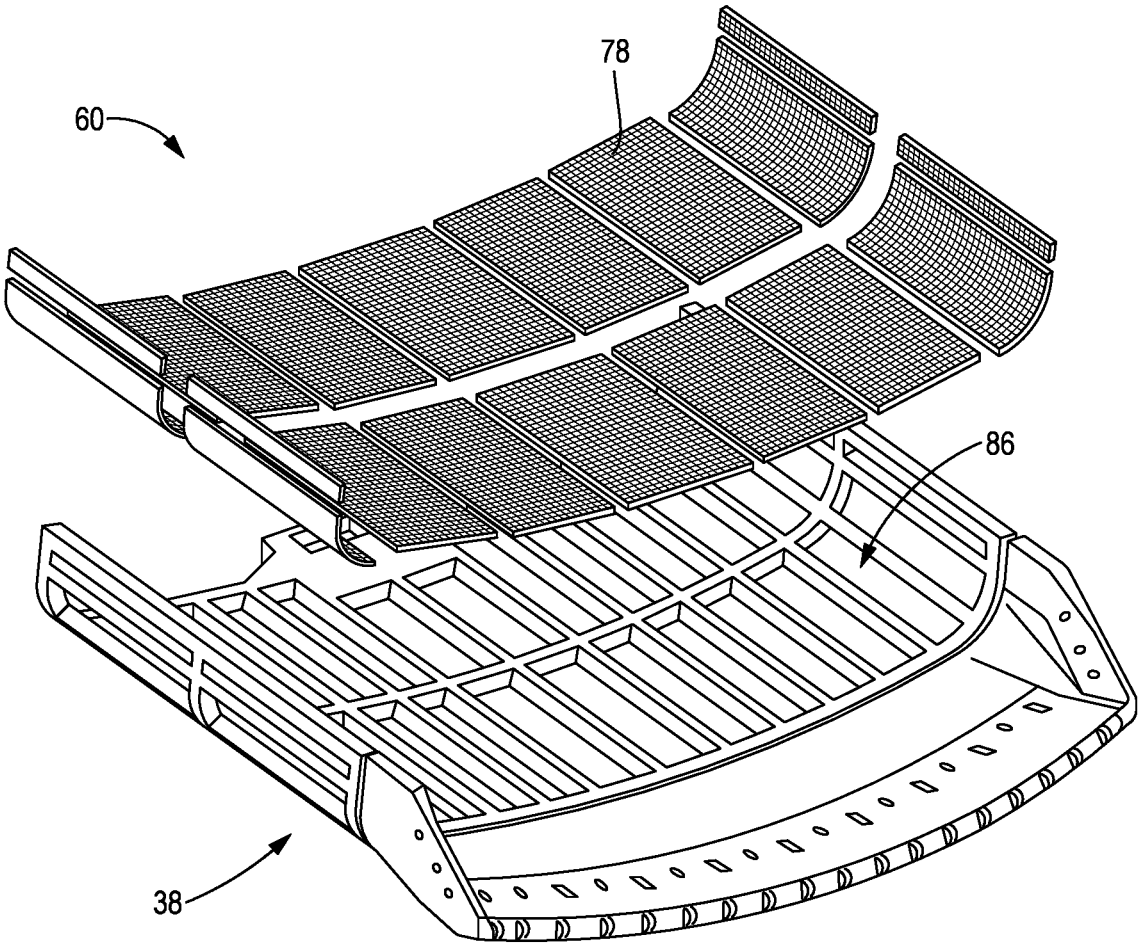
FIG. 6 is a side perspective exploded view of a dipper bowl and a liner of a dipper bowl constructed in accordance with an embodiment of the present invention.
Figure 7:
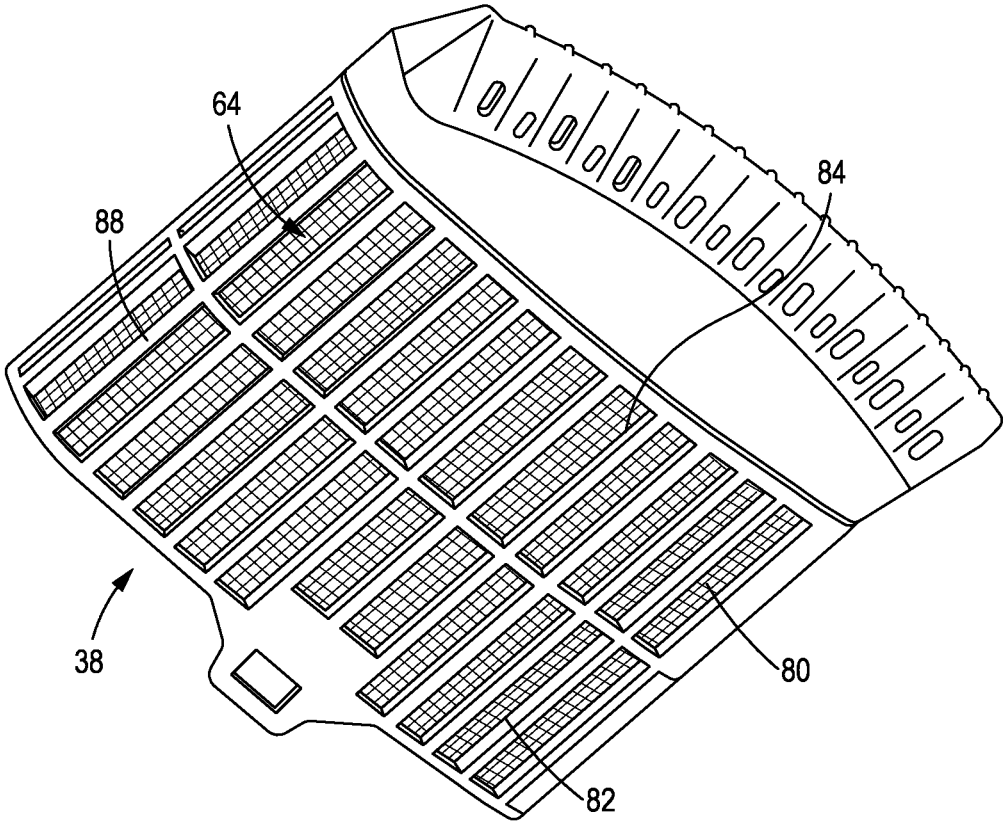
FIG. 7 is a bottom perspective view of a dipper bowl having a liner constructed in accordance with an embodiment of the present invention.

Referring now to FIGS. 1-3, the dipper 30 is shown, according to an exemplary embodiment. The dipper 30 may include a body 32 with a top wall 34 and a pair of side walls 36, as well as a bowl 38 and a rear door 40. The top wall 34, side walls 36, bowl 38 and rear door 40 may define a cavity 42 for gathering worksite material. A plurality of mounting brackets 48 may be included on a top surface 44 of the top wall 34. The mounting brackets 48 may enable attachment of the boom handle 24, a boom lever 50, the rear door 40 to the dipper 30, and other components of the work machine 10 that may assist in positioning the dipper during operation. The boom lever 50, for example, may pivot the dipper relative to the boom handle 24, which in turn pivots relative to the boom 26.

The rear door 40 may be pivotably mounted to the dipper 30 by one or more of the plurality of mounting brackets 48 fixed to the top surface 44 of the top wall 34. The rear door 40 may pivot between a closed position and an open position. In operation, when the rear door 40 is in a closed position (as shown in FIG. 1), worksite material may be retained within the cavity 42 enabling transport of the material in the dipper 30. When depositing the worksite material, for example, the rear door 40 may pivot into the open position via release of a latching mechanism 46, which may be unlocked by a pull string 48, a hydraulic cable (not shown), an electric latching mechanism with an electric wire (not shown), or other releasing mechanism as is known in the art. When the rear door 40 pivots into the open position, worksite material may be deposited from the cavity 42, through the rear door 40 and onto the ground, into a dump truck or onto a conveyor, for example.

The dipper 30 may further comprise a lip 52 coupled to a bottom surface 54 of each of the pair of side walls 36 and to a front surface 56 of the bowl 38. The lip 52 may extend outwardly from the front surface 56 of the bowl 38, and may be substantially parallel with the top wall 34. The lip may include a plurality of adaptors 58, with each adaptor configured to hold a digging tooth (not shown).

With continued reference to FIGS. 2 and 3, as well as FIGS. 4-7, and as mentioned above, the dipper 30 may include the bowl 38. The bowl 38 may provide both a structure and a rigidity to the dipper 30 to support digging and transporting of worksite material. However, the abrasive and high impact nature of the worksite material gathered and transported through the dipper 30 can quickly erode and otherwise damage the bowl 38 during operation. As such, the bowl 38 may include a liner 60 to prolong the life of both the bowl and the dipper 30.

The bowl 38 may be attached to the bottom surface 54 of each side wall 36, for example by welding. The bowl 38 may be formed by a lattice framework 66 that may be cast or fabricated from a plurality of bars 62 that may be welded together to form a plurality of openings 64, generating the lattice or grid-like arrangement. In one embodiment, the bars 62 may be made of 500 Bhn solid steel and have a depth d of at least 4 inches, although the composition and dimensions of the bars within the lattice framework 66 may vary according by the type of work machine 10 and specific application. Similarly, while the lattice framework 66 of the bowl 38 is illustrated with a grid-like arrangement, other arrangements are also contemplated.

To protect the bowl 38 from damage during operation of the work machine, and to add structural rigidity to the dipper 30, the bowl may include the liner 60, which may be formed of a plurality of solid plates 68, including a plurality of flat plates 70 and a plurality of curved plates 72. While the liner 60 is illustrated with 14 flat plates and 4 curved plates, other sizes and arrangements are also contemplated depending on the dipper 30 dimensions. To ensure a proper fit between the plates 68 and the bowl 38, the shape of the plates, whether curved or flat, should correspond to the shape of the bowl 38. As such, the bowl 38 may include a flat central region 74, at least one curve edge region 76, and at least one flat side region 78. In this arrangement, the flat plates 70 may matingly engage the flat central region 74 and the flat side region 78, while the curved plates 72 may matingly engage the curve edge region 76. As illustrated, the flat plates 70 within the flat side region 78 may have a smaller width than the flat plates 70 with the flat central region 74, but it should be understood that the dimensions of the plates may vary pursuant to the design and dimensions of the dipper 30 and bowl 38. Additionally, the material and thickness of the plates 68 may vary with the application and type of worksite material. In standard applications, such as in medium impach/medium abrasion applications, the plates 68 may be cut from 3-inch thick 500 Bhn solid steel. However, in low impact/high abrasion applications, each plate 68 may be constructed from 2-inch thick chromium carbide. In a further example, such as in high impact/low abrasion applications, each plate 68 may be constructed from 4-inch thick 500 Bhn solid steel.

Each plate 68 of the liner 60 may include a top surface 78 and a bottom surface 80. During installation of the liner 60, each plate 68 may be attached to the lattice frame 66 at the bottom surface 80. While other methods may be known in the art, it is preferred that the bottom surface 80 of each plate 68 be welded to the lattice frame 66 along an interior perimeter 82 of each opening 64. Each weld 84 (FIG. 7) is consequently protected from damage and erosion by the bars 62 of the lattice framework 66.

INDUSTRIAL APPLICABILITY

In operation, the present disclosure finds utility in various industrial applications, such as, but not limited to, in transportation, mining, construction, industrial, earthmoving, agricultural, and forestry machines and equipment. For example, the teachings of the present disclosure may prove beneficial to earth moving machines including, but not limited to, dippers, shovels, and excavators. More specifically, the present disclosure provides a work machine with a dipper bowl having a lattice framework, and dipper bowl liner formed from a plurality of solid plates that may be welded to the bowl through the lattice framework. The present bowl and liner greatly reduces operation and manufacturing costs, and extends the life of the bowl and the dipper as a whole.

In accordance with the embodiments described in the present disclosure, the present bowl 38 may include a fabricated lattice framework 66. The lattice framework 66 may be cast or fabricated by welding a plurality of bars 62 in a grid, or lattice, pattern, such that openings 64 are formed between the bars 62. The liner 60, formed from the plurality of individual plates 68, protects an interior surface 86 of the bowl 38 from wear incurred during use. The plates 68 may be solid and made from steel. Accordingly, the plates 68 may be attached to the lattice framework 66 by welding the bottom surface 80 of each plate along an interior perimeter 82 of each opening 64. In this manner, the depth d of the bars 62 of the lattice framework 66 protects the welds from damage during operation of the work machine 10. For example, in operation, as the dipper 30 is inserted into, and removed from, worksite materials, an exterior surface 88 of the bowl 38 and the top surface 78 of the plates 68 may wear down or erode over time due to contact with abrasive worksite materials.

As the bowl 38 or liner 60 wears down, replacement may be necessary. Typical bowls used in similar industrial applications are solid, and cast or fabricated from steel, making them heavy and costly to manufacture due to the amount of material needed. As such, when a solid bowl is damaged, the entire bowl must be replaced, and in some systems, the entire dipper must be replaced. The presently disclosed lattice framework 66, however, provides the rigidity and strength necessary for operation of the work machine 10, while minimizing the time and cost for replacing sections of the bowl. For example, if a region of the dipper is damaged during operation, any damaged bars 62 may simply be cut out and replaced with new bars. In addition, the bowl 38 may be replaced by removing the welds between the bowl and the bottom surface 54 of the side walls 36, and welding a new bowl in place.

Typical liners used in similar industrial applications are thick and not solid, but rather must include at least one aperture in the plate for welding purposes. When used in combination with a solid bowl, typical liners must be fixed to the surface of the bowl by welding from the top surface, through the aperture. This arrangement directly exposes the welds to the abrasive worksite materials used during operation. However, as mentioned above, the present plates 68 are welded from a bottom surface 80, and the welds are protected by the depth d of the lattice framework 66. Further, in a manner similar to that described above, the liner 60 includes a plurality of plates 68 that may be selectively and independently replaced as necessary. In operation, when a plate 68 wears down, the welds may be removed from the bottom surface 80 of the damaged plate, and the individual plate may be replaced with a new plate.

The skeleton-like structure of the present framework 66 in combination with a thinner plate reduces the weight of a typical bowl and dipper by nearly 20%. A typical bowl and liner may weigh approximately 13,650 kg, while the present system weighs only approximately 11,078 kg. This weight reduction relates directly to the amount of material required for manufacture, and illustrates clearly a significant reduction in the cost of manufacture and replacement. In addition, the work life of the components described herein, when arranged in the embodiments described herein, may be extended beyond a typical lifespan of a dipper bowl and liner. For example, the typical life of the lattice framework 66, as described herein, may be approximately 5 years, and each plate of the liner may last at least 12,000 work hours before replacement may be necessary.

While aspects of the present disclosure have been particularly shown and described with reference to the embodiments above, it will be understood by those skilled in the art that various additional embodiments may be contemplated by the modification of the disclosed machines, systems and assemblies without departing from the scope of what is disclosed. Such embodiments should be understood to fall within the scope of the present disclosure as determined based upon the claims and any equivalents thereof

What is claimed is:

1. A dipper of a work machine, the dipper comprising:
a body including a plurality of walls;
a rear door;
a bowl fixed to the body having a lattice frame formed by a plurality of openings extending through the lattice frame; and
a liner formed from a plurality of plates, each plate having a top surface that faces an interior of the bowl that is configured to receive material and a bottom surface opposite the top surface, each plate being welded to the lattice frame from the bottom surface of the plate to form a cavity, the cavity having a single open side due to the liner closing a top end of the cavity and the lattice frame defining an open bottom end of the cavity.

2. The dipper of claim 1, further comprising a lip coupled to the body and the lattice frame, the lip including a plurality of adaptors, each adaptor configured to receive a digging tooth.

3. The dipper of claim 1, wherein the rear door is configured to pivot between a closed position and an open position.

4. The dipper of claim 1, wherein the lattice frame is formed from a plurality of bars arranged in a grid pattern and forming a plurality of rectangular openings.

5. The dipper of claim 4, wherein each plate is welded to the lattice frame along an interior perimeter of each of the plurality of openings, such that a plurality of welds, formed along different interior perimeters of different openings, are placed on the same plate.

6. The dipper of claim 5, wherein the bars are solid steel.

7. The dipper of claim 1, wherein each plate is solid.

8. The dipper of claim 1, wherein the plurality of plates includes a plurality of flat plates and a plurality of curved plates.

9. A work machine, comprising:
a rotatable frame;
a plurality of ground engaging elements;
a boom pivotably coupled to the frame;
a dipper coupled to the boom, the dipper comprising:
a body including a plurality of side walls and a top wall;
a rear door;
a lattice frame removably attached to each of the plurality of side walls, the lattice formed by a plurality of openings, each of the openings having a top end and a bottom end; and
a liner formed from a plurality of plates, each plate having a top surface that contacts material present in the dipper and a bottom surface opposite the top surface, each plate being welded to the lattice frame from the bottom surface of the plate to secure the plate at the top end of one or multiple openings such that the plates and the lattice frame form cavities having a single open side.

10. The work machine of claim 9, wherein the lattice frame is formed from a plurality of bars arranged in a grid pattern and forming a plurality of rectangular openings.

11. The work machine of claim 10, wherein the each plate is welded to the lattice frame along an interior perimeter of each of the plurality of openings.

12. The work machine of claim 9, wherein the lattice frame includes a flat bottom region, a curved edge region and a flat side region.

13. The work machine of claim 12, wherein the plurality of plates includes a plurality of flat plates and a plurality of curved plates.

14. The work machine of claim 13, wherein the plurality of flat plates are attached to the flat bottom region and the flat side region of the lattice frame, and the plurality of curved plates are attached to the curved edge region of the lattice frame.

15. The work machine of claim 9, wherein each of the plurality of plates is solid.

16. The work machine of claim 15, wherein the plurality of plates are one of steel or chromium carbide.

17. A dipper of a work machine configured to transport material at a worksite, the dipper comprising:

a body including a plurality of side walls and a top wall;

a rear door pivotably attached to the top wall, the rear door and the body defining a cavity;

a bowl attached to the body at a bottom edge of each of the plurality of side walls, the bowl including a lattice frame formed from a plurality of bars arranged in a grid pattern and spaced so as to define a plurality of openings; and a liner formed from a plurality of plates, each plate having a top surface configured to contact the material present in the cavity and a bottom surface opposite the top surface, each plate being welded to the lattice frame from the bottom surface and along a perimeter of each of the plurality of openings such that the plates and the lattice frame form cavities having an open bottom side and a top side that is covered by one or more plates.

18. The dipper of claim 17, wherein each plate is solid steel.

19. The dipper of claim 17, wherein the bowl includes a flat bottom region, a curved edge region and a flat side region, and wherein the plurality of plates includes a plurality of flat plates and a plurality of curved plates.

20. The dipper of claim 19, wherein the plurality of flat plates are welded to the flat bottom region and the flat side region of the bowl, and wherein the plurality of curved plates are welded to the curved edge region of the bowl.

* * * * *